US005558799A

United States Patent [19]

Kang

[11] Patent Number: 5,558,799

[45] Date of Patent: Sep. 24, 1996

[54] APPARATUS AND METHOD FOR CONTROLLING TURNTABLE OF MICROWAVE OVEN

[75] Inventor: Dae B. Kang, Changwon, Rep. of Korea

[73] Assignee: Goldstar Co., Ltd., Seoul, Rep. of Korea

[21] Appl. No.: 366,482

[22] Filed: Dec. 30, 1994

[30] Foreign Application Priority Data

Dec. 30, 1993 [KE] Kenya ..... 1993-31371

[51] Int. Cl.[6] ..... H05B 6/78

[52] U.S. Cl. ..... 219/754; 219/518; 99/443 R

[58] Field of Search ..... 219/754, 702, 219/704, 752, 518; 99/443 R

[56] References Cited

U.S. PATENT DOCUMENTS

| | | | |
|---|---|---|---|
| 4,520,250 | 5/1985 | Ishihara et al. | 219/754 |
| 4,895,067 | 1/1990 | Ohji et al. | 219/754 |
| 5,347,108 | 9/1994 | Minakawa et al. | 219/696 |
| 5,369,254 | 11/1994 | Kwon | 219/708 |
| 5,440,105 | 8/1995 | Kim | 219/754 |

FOREIGN PATENT DOCUMENTS

| | | | |
|---|---|---|---|
| 2-276190 | 11/1990 | Japan | 219/754 |
| 3-163791 | 7/1991 | Japan | 219/754 |
| 6-300271 | 10/1994 | Japan | 219/754 |

*Primary Examiner*—Philip H. Leung

[57] ABSTRACT

A device and a method for controlling the rotation of the turntable of a microwave oven to return to the same position as when the present cooking cycle began. The device includes: an optical turntable rotation sensor unit, which is installed so as to emit an optical signal into a transmission hole, formed in the shaft of the turntable, during cooking and which is to recognize the rotation of the turntable by intermittently receiving the optical signal that passes through the transmission hole; and a microcomputer for controlling the rotation of the turntable after cooking has ended, if necessary, on the basis of the data from the turntable rotation sense unit. The rotation sense unit includes a photodiode and a phototransister. The transmission hole formed in the turntable shaft enables the optical signal emitted from the photodiode to pass through it and reach the phototransister.

13 Claims, 4 Drawing Sheets

APPARATUS AND METHOD FOR CONTROLLING TURNTABLE OF MICROWAVE OVEN

BACKGROUND OF THE INVENTION

The present invention relates to an operation of a turntable of a microwave oven, and more particularly to an apparatus and a method for controlling the stop position of the turntable of the microwave oven to coincide a starting and ending position of the food placed on the turntable so as to promote usefulness.

As illustrated in FIG. 1, the conventional invention comprises a microcomputer 2 for storing key data inputted from a key input unit 1 and for controlling the total system of the microwave oven by read of the stored data, a relay drive unit 3 for controlling a high voltage transformer which oscillate a magnetron and the turntable according to the control of the microcomputer 2, a door sense unit 4 for sensing an opening and closing of a door, a display unit 5 for displaying various information, for example, the status and time of the operation of the microwave oven, an alarm generation unit 6 to operate a buzzer for sounding the termination of cooking, and a power supply unit 7 for supplying the power to each unit of the system.

The foregoing conventional invention will be described in detail as follows.

To start cooking of food placed on the turntable in the heating chamber, when the user pushes the start button located in a key input unit 1, the microcomputer 2 controls the types of cooking in accordance with the stored data.

First, the microcomputer 2 is sensing the position of the door through the door sense unit 4, and making a display unit 5 show the various information, including cooking time when the sensed value indicates the closing status of the door. Simultaneously, microcomputer 2 controls the relay drive unit 3, so as to rotate the turntable and to make a high voltage transformer oscillate the magnetron so that microwave energy is oscillated into the heating chamber to cook the food.

During the cooking process, the microcomputer 2 is constantly checking the cooking time set by the user and controls the alarm generation unit 6, so as to stop the rotation of the turntable and further to stop the oscillation of magnetron when the count down result reaches to zero.

However, in the conventional microwave oven, if the food is placed in a forward position when the cooking is terminated, the relay drive unit 3 intercepts the power supplied to the turntable, so that the turntable motor stops and the turntable also stops in a random position.

Accordingly, the conventional microwave oven has many problems with taking out the food in the microwave oven after the cooking is over, because of the starting and ending position where the food is placed on the turntable are different.

SUMMARY OF THE INVENTION

The object of the present invention is to provide the apparatus and the method for controlling the stop position of the turntable of the microwave oven such that the starting and ending positions of the food placed on the turntable are same so that the food can be taken out more easily.

In order to achieve the above mentioned objective, the present invention comprises a turntable rotation sense unit, which is installed in a straight line with a transmission hole formed in the turntable shaft, for emitting the optical signal into the transmission hole during the cooking and for sensing the rotation of the turntable by receiving the optical signal passed through the transmission hole, and the microcomputer, which controls the turntable motor on the basis of the data sensed by the turntable rotation sense unit, regarding the rotation of the turntable for controlling a stop position of the turntable to the same position where the operation was initiated.

DETAILED DESCRIPTION OF THE INVENTION

Figure 1:
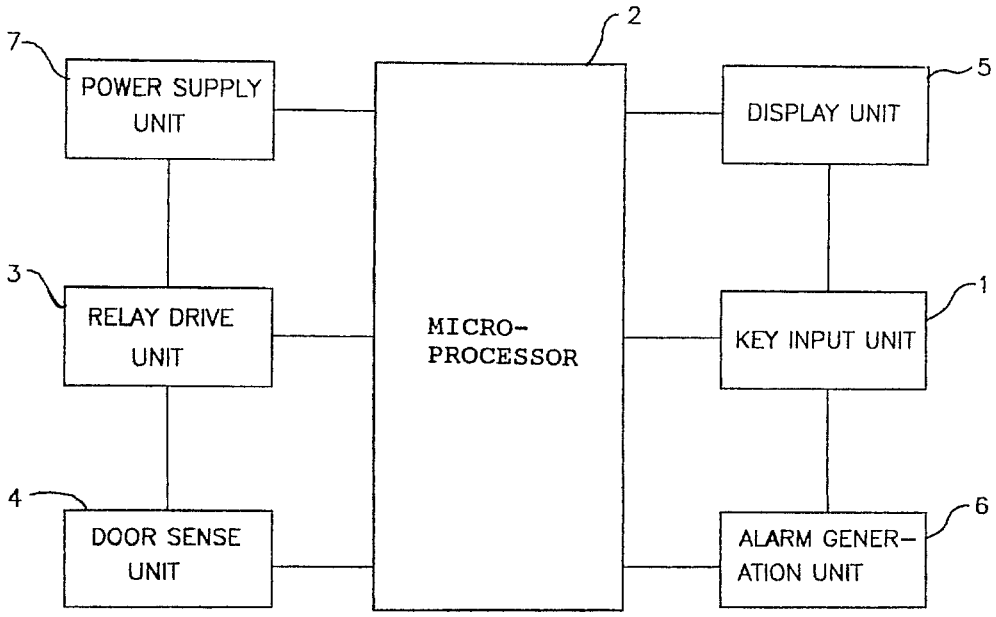
FIG. 1 PRIOR ART
FIG. 1 is a block diagram of a conventional microwave oven.
Figure 2:
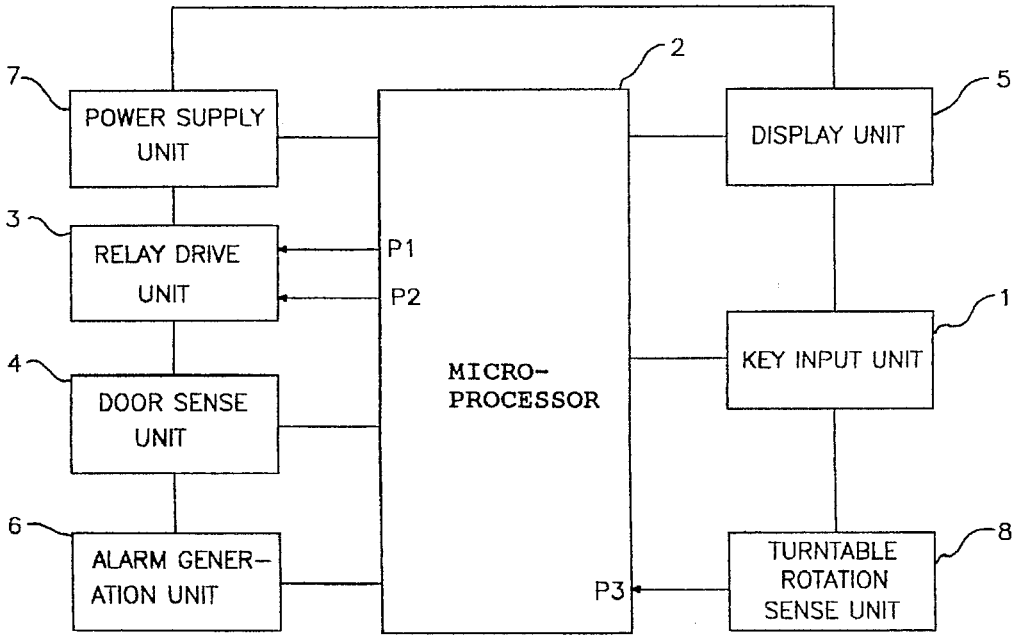
FIG. 2 is a block diagram of an apparatus for controlling a stop position of the turntable of the microwave oven according to the present invention.

FIG. 2 illustrates the apparatus for controlling a stop position of the turntable of the microwave oven according to the present invention. This apparatus comprises the microcomputer 2 for storing key data inputted from the key input unit 1 and for controlling the operation of the whole system of the microwave oven by controlling the turntable motor sensed by the rotation sense unit 8, the relay drive unit 3 for controlling the high voltage transformer, which oscillates the magnetron and the turntable by the order of the microcomputer 2, the door sense unit 4 for sensing the opening and closing of the door of the microwave oven, the display unit 5 to display the status and the time, etc, of the microwave oven, the alarm generation unit 6 to operate a buzzer for alarming the termination of cooking, the power supply unit 7 for supplying the power to each unit of the system, the turntable rotation sense unit 8, which is installed in a straight line with the transmission hole of the turntable shaft and emits the optical signal into the transmission hole, for sensing the rotation of the turntable by receiving the signal passed through the transmission hole.

The effects of the present invention are described in detail (Refer to FIGS. 3 to 6).

When an user starts to cook food placed on the turntable in the heating chamber by pushing the button to select the type of cooking desired, the microcomputer 2 reads the data to conduct a selected type of cooking.

First, the microcomputer 2 first checks the present states of the system, then checks as to whether the food is in cooking process or not. If the cooking is stopped, then microcomputer reads the data as to the position of the door sensed by the unit 4. Or, the data is indicating the door is closed, microcomputer makes the display unit 5 display the various information.

Thereafter, the microcomputer 2 outputs a high signal through a port P1, P2 to operate the turntable drive relay and the high voltage transformer drive relay of the relay drive unit 3.

Figure 5:
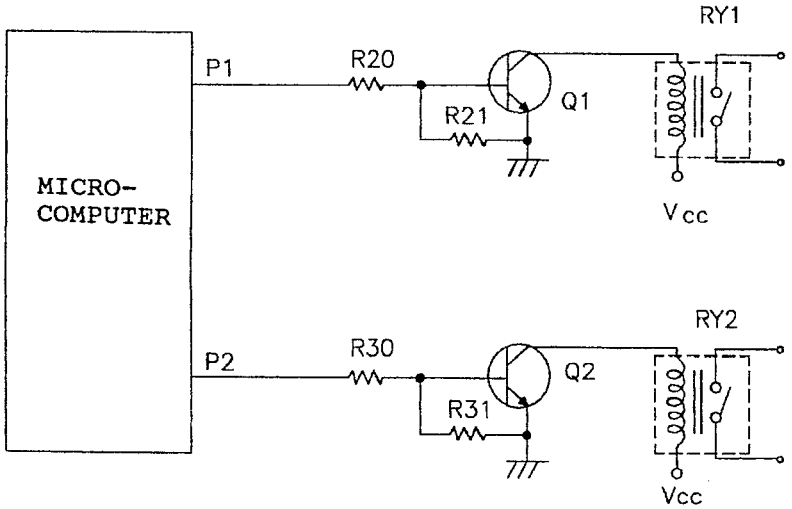
FIG. 5 is a detailed schematic diagram of a relay drive unit of the FIG. 2; and, FIG. 6 is a flow chart explaining the control of the turntable of the microwave oven according to the present invention.
Figure 6:
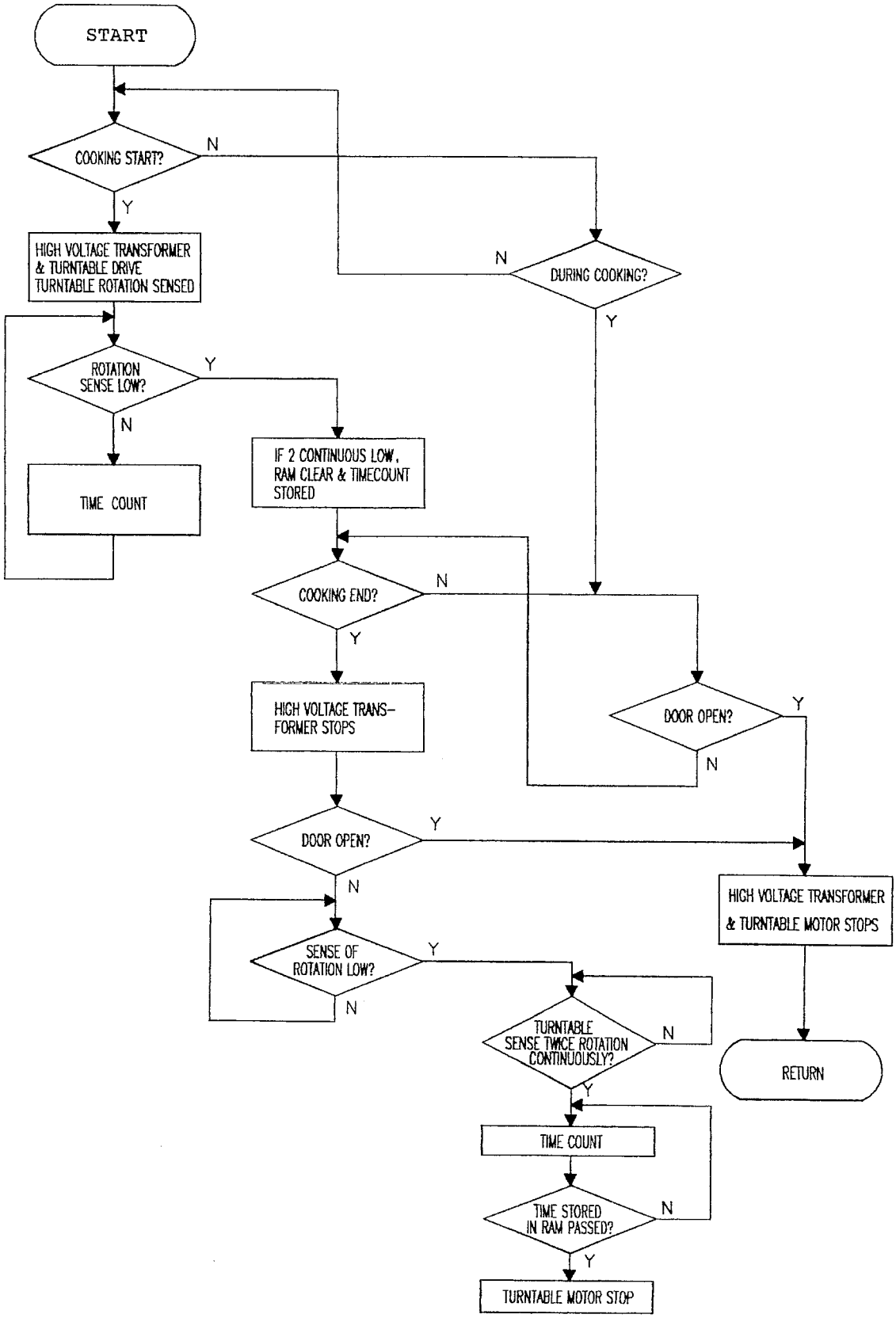
Figure 7:
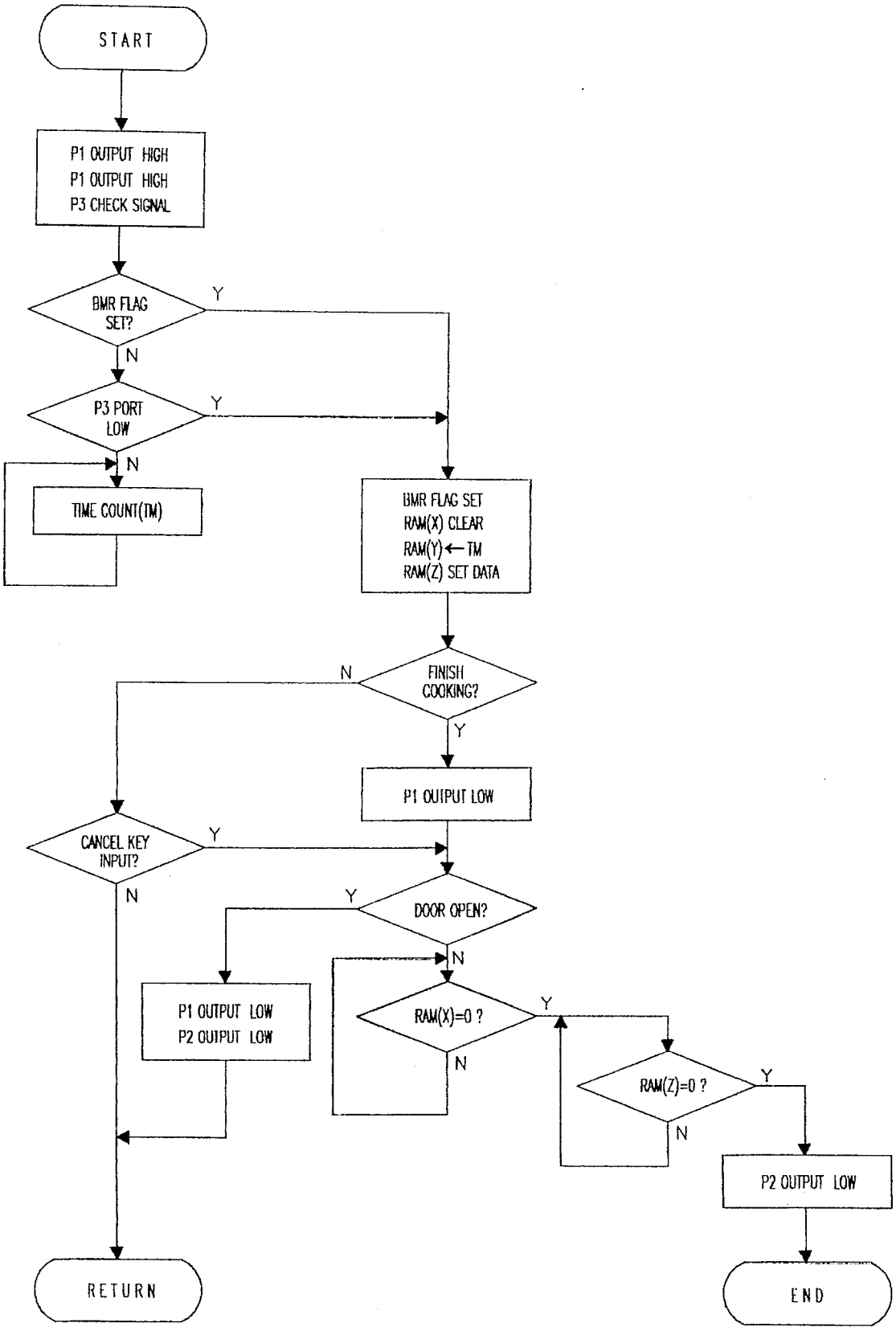
FIG. 7 is a flow chart explaining the operation of the microcomputer according to the present invention.

As illustrated in FIG. 5, when a high signal is outputted from the port P1, a first switching member (Q1) within said relay drive unit is turned on, the high voltage transformer drive relay RY1 is on, and the oscillation voltage is added to high voltage transformer in order to operate the magnetron for oscillating the microwave so that the food placed on the turntable will be cooked.

In Addition, when a high signal is outputted from port P2, a second switching member Q2 in said relay drive unit is turned on, the turntable motor drive relay RY2 is on so that the turntable motor starts to operate.

As mentioned above, the microcomputer 2 searches the inputted data while the turntable and the high voltage transformer is operating. At this stage, the inputted data of port 3 is the output of the turntable rotation sense unit 8 of the present invention.

Figure 4:
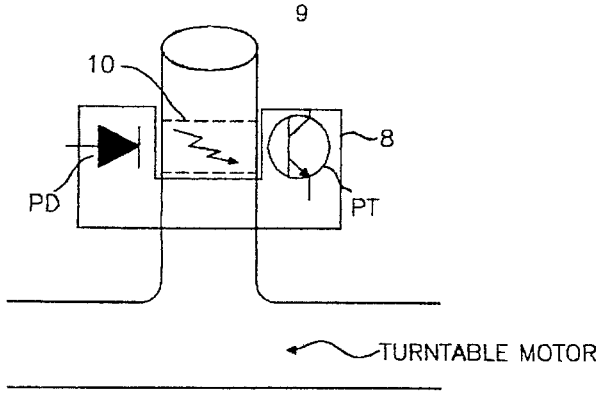
FIG. 4 is an installed position view of a photocoupler applying to the present invention.

As illustrated in FIG. 4, the turntable rotation sense unit 8 photodiode (PD) oscillating an optical signal located a prescribed distance from the center of the turntable shaft 9, and an optical signal transmission hole 10 is formed in a straight line with the cathode of the photodiode.

Additionally, the phototransister (PT) is in an opposite side of the transmitting hole at the same distance from the center of the turntable shaft 9 so that the phototransister PT can detect an optical signal emitted through the transmission hole. An optical signal emitted from the photodiode through the transmission hole can be detected by the phototransistor.

Figure 3:
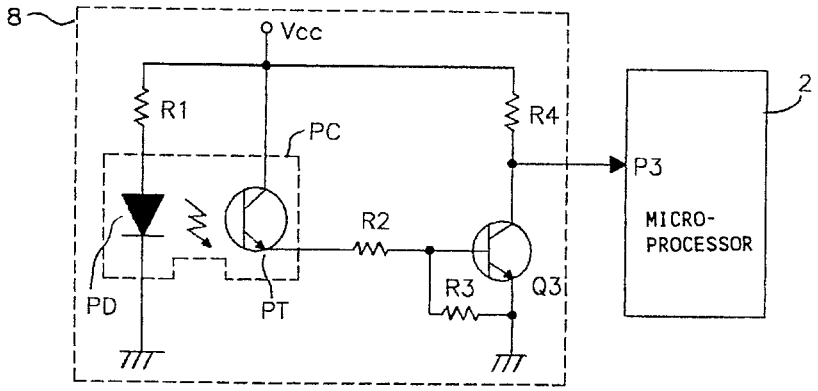
FIG. 3 is a detailed block diagram of a turntable rotation sense unit of the FIG. 2.

Further, the turntable rotation sense unit 8 is fixed, maintaining the predescribed distance from the turntable shaft 9. If the voltage is added to the photodiode PD of the turntable rotation sense unit as illustrated in FIG. 3 with the initiation of cooking process, said photodiode PD starts to emit an optical signal.

The optical signal oscillated from the photodiode (PD) reaches the phototransister (PT) through the transmission hole 10 formed in the turntable shaft 9, and only in this occasion where the optical signal reaches the phototransister PT, is the phototransister turned on to output the voltage to the emitter.

In other words, the only occasion where the phototransister is turned on is the time when the optical signal emitted from the photodiode PD is passing through the transmission hole 10. Thus, the phototransister PT is turned on twice while shaft 9 of the turntable motor rotates once.

On the other hand, when the voltage is outputted to the emitter of said phototransister (PT), said voltage is divided into the two resistors R2, and R3, a third switching member Q3 is turned on, and then the low signal is inputted in port P3 of the microcomputer 2. The microcomputer 2 is able to sense the number of the rotation of the turntable by reading the inputted data of the port P3.

As above mentioned method, a ram(x) of the microcomputer 2 is used to store a count of the output of the turntable rotation sense unit 8 during the cooking.

When the cooking is started, the microcomputer 2 calculates a time period to the first instance that the low signal is inputted to port P3.

Thereafter, when the low signal is inputted through port P3 for the first time, the microcomputer 2 stores the time data between the initiation of the cooking and first input of the low signal in a ram(y), Next, the microcomputer 2 clears the ram(x) when the low signal is inputted a second time, i.e., two times in a row, so that the computer recognizes that the turntable has completed one rotation.

During the above mentioned process, the microcomputer 2 continuously is checking the state of the door through the door sensing unit 4. If the microcomputer 2 senses the opening of the door before elapsing the preset time period, the microcomputer 2, through the relay drive unit stops the turntable and cuts the voltage of the high voltage transformer immediately to protect the user from imminent danger caused by the leakage of any microwave energy, and makes a buzzer sound to let the user know of the opening of the door through alarm generation unit 6.

If the prescribed cooking time of the microcomputer 2 has elapsed the microprocessor 2 causes the alarm buzzer to sound to indicate the termination of the cooking to a user. At this time, the mircocomputer outputs the low signal to make the high voltage transformer drive relay RY1 in off position so as to stop the driving of the magnetron.

Thereafter, if the opening of the door is sensed by the microcomputer 2 through the door sense unit 4, the computer outputs the low signal immediately to move the turntable motor drive relay RY2 to the off position so as to stop the turntable motor.

In addition, if the door is closed when the driving of the magnetron is stopped, the microcomputer 2 performs a calculation on the numbers of signals inputted through Port P3; clears the ram (x); and continues to rotate the turntable until a count of the low signal becomes an even number.

The microcomputer 2 stores in a ram (z) the extra motor rotation time period data, which is calculated by deducting the initial time (between the initiation of cooking and a first low signal inputted to port P3, stored in ram (y)) from the time of completing one rotation of the turntable.

When the number of low signals inputted to port P3 becomes even, which means the completion of the rotation of the turntable, the microcomputer 2 makes the turntable rotate for the extra motor rotation time stored in ram(z) and stops the turntable to when the time has elapsed so that the position after the cooking is such that the position when the cooking process is initiated.

As described in detail, the present invention makes it more convenient for the user when they are taking out the food after the cooking process is completed.

While specific embodiment of the invention have been illustrated and described wherein, it is to realize that modifications and changes will occur to those skilled in the art. It is therefore to be understood that the appended claims are intended to cover all modifications and changes as fall within the true spirit and scope of the invention.

What is claimed is:

1. A method for controlling a turntable of a microwave oven, comprising the steps of:

a) driving a magnetron and a turntable motor during a cooking cycle;

b) checking an output of a means for sensing rotation positions of the turntable;

c) storing a time period, $T_i$, from a time of initiating the cooking cycle to a time of reaching a first half rotation position of a turntable shaft;

d) stopping energization of the magnetron at the end of the cooking cycle; and e) controlling the turntable motor to continue rotating after the end of a full rotation of the turntable with respect to the first rotation position for an extra time, $T_x=T_p-T_i$, where $T_p$ is a period of rotation of the turntable, such extra rotation returning the turntable to a starting position.

2. A method of operating a turntable in a microwave oven, which rotates during a cooking cycle, to enable the turntable to be returned to a starting position after completion of a cooking cycle, the turntable including a sensor for producing a Θ signal at each instance that the turntable rotates through a predetermined angle Θ, where n*Θ=360°, and n is an integer, comprising:

a) determining an initial time, $T_i$, from the start of a cooking cycle until a first Θ signal is produced by the sensor; and b) sensing full rotations of the turntable after the first Θ signal is produced by the sensor;

c) determining an extra turntable rotation time, $T_x$, necessary to return the turntable to a starting position after a full rotation, as a function of $T_i$.

3. A method as in claim 2, wherein step c) includes:

c1) calculating $T_x=T_p-T_i$, where $T_p$ is a predetermined period of rotation of the turntable.

4. A method as in claim 3, further comprising:

d) determining, prior to step c), the period of rotation $T_p$ of the turntable by measuring an elapsed time during which n instances of the Θ signal occur.

5. A method as in claim 2, wherein:

n=2;

Θ=180°; and wherein the initial time $T_i$ corresponds to a time necessary for the turntable to rotate less than 180°.

6. A method as in claim 2, further comprising:

d) controlling, at the end of the cooking cycle and after a full rotation is sensed, the turntable to rotate for the extra turntable rotation time, $T_x$.

7. A device for operating a turntable in a microwave oven, which rotates during a cooking cycle, to enable the turntable to be returned to a starting position after completion of a cooking cycle, comprising:

a sensor for producing a Θ signal at each instance that the turntable rotates to a predetermined angle of rotation Θ, an integer number, n, of the Θ signals being produced for each 360° rotation of the turntable;

$T_i$-means, responsive to the sensor, for timing an initial time, $T_i$, from the start of a cooking cycle until a first Θ signal is produced by the sensor; and $T_x$-means, responsive to the $T_i$-means, for determining an extra turntable rotation time, $T_x$, necessary to return the turntable to a starting position after a full 360° rotation of the turntable, as a function of $T_i$.

8. A device as in claim 7, wherein the $T_x$-means includes:

a $T_x$-calculator for calculating $T_x=T_p-T_i$, where $T_p$ is a predetermined period of rotation of the turntable.

9. A device as in claim 8, further comprising:

$T_p$-means, for determining the period of rotation $T_p$ of the turntable by measuring an elapsed time during which n instances of the Θ signal occur.

10. A device as in claim 7, wherein:

n=2;

Θ=180°; and wherein the initial time $T_i$ corresponds to a time necessary for the turntable to rotate less than 180°.

11. A device as in claim 7, further comprising:

a controller, responsive to the $T_x$-means, for controlling, at the end of the cooking cycle and after a full 360° rotation of the turntable, the turntable to rotate for the extra turntable rotation time, $T_x$.

12. A device as in claim 7, wherein:

the sensor is an opto-electrical sensor.

13. A device as in claim 7, wherein:

the sensor includes:

a photodiode for emitting light;

a photosensor for sensing light of a frequency range emitted by the photodiode; and the turntable includes:

a platter upon which food to be cooked is placed;

a motor for rotating the platter; and a shaft for mechanically connecting the platter to the motor;

the shaft including an aperture collinear with a diameter of the shaft;

the photodiode and the photosensor being arranged on opposite sides of the shaft such that, as the shaft turns, the aperture therein periodically permits light from the photodiode to reach the photosensor.

* * * * *